United States Patent [19]

Fessler

[11] 4,027,498

[45] June 7, 1977

[54] AIR CONDITIONER

[75] Inventor: Herman Sylvester Fessler, Coon Rapids, Minn.

[73] Assignee: McLean Engineering Midwest, Maple Grove, Minn.

[22] Filed: Apr. 2, 1976

[21] Appl. No.: 673,068

[52] U.S. Cl. ..... 62/263
[51] Int. Cl.[2] ..... F25D 23/12
[58] Field of Search ..... 62/262, 263

[56] References Cited

UNITED STATES PATENTS

| | | | |
|---|---|---|---|
| 3,097,506 | 7/1963 | Blakesley, Sr. | 62/263 |
| 3,128,610 | 4/1964 | Moore | 62/263 |
| 3,308,634 | 3/1967 | Smith | 62/263 |
| 3,313,122 | 4/1967 | Laing | 62/263 |
| 3,635,046 | 1/1972 | Sato et al. | 62/262 |
| 3,871,188 | 3/1975 | Vold et al. | 62/262 |

*Primary Examiner*—Lloyd L. King
*Attorney, Agent, or Firm*—Henry C. Kovar

[57] ABSTRACT

An air conditioner for being mounted to the wall of an enclosure box is disclosed, the air conditioner having a cabinet, a refrigeration chassis mounted in the cabinet and having a L-shaped frame attached to and dividing the cabinet into first and second chambers with a compressor and condenser in the first chamber and an evaporator in the second chamber, the cabinet has a condenser fan ducted into a screen covered exhaust plenum at the top of the cabinet and the second chamber has a fan for blowing cold air from the evaporator coil into the enclosure, an inlet plenum in the back of the cabinet is provided for drawing hot air from the enclosure and there is a filter holder on the cabinet for holding a filter of twice the area of a condenser air inlet with a filter being turnable end for end in the holder for being used twice.

25 Claims, 5 Drawing Figures

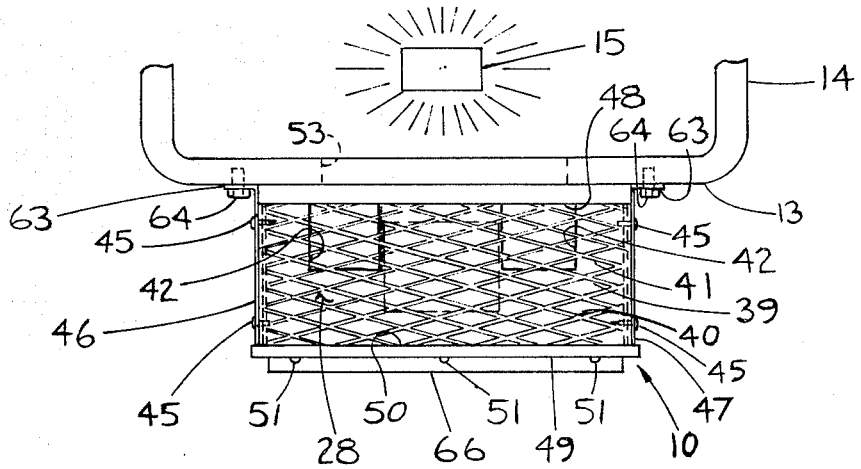
FIG. 2
FIG. 3
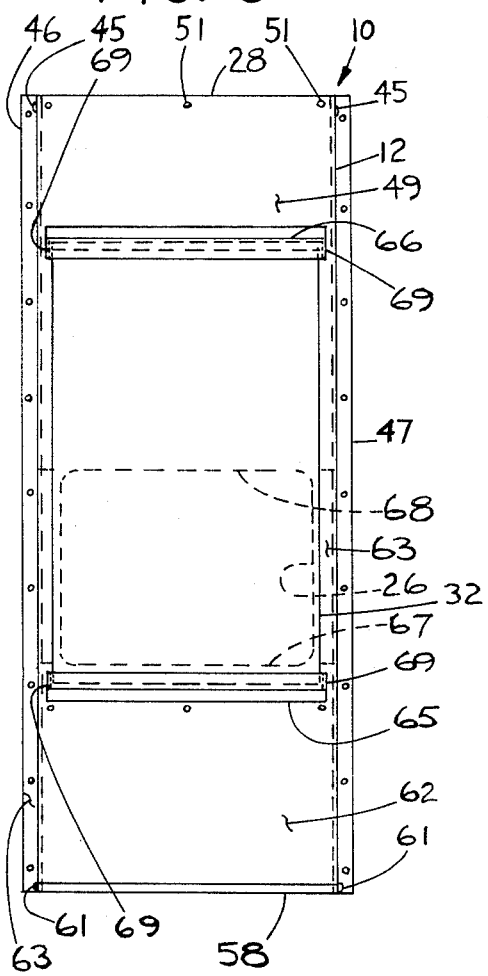
FIG. 4
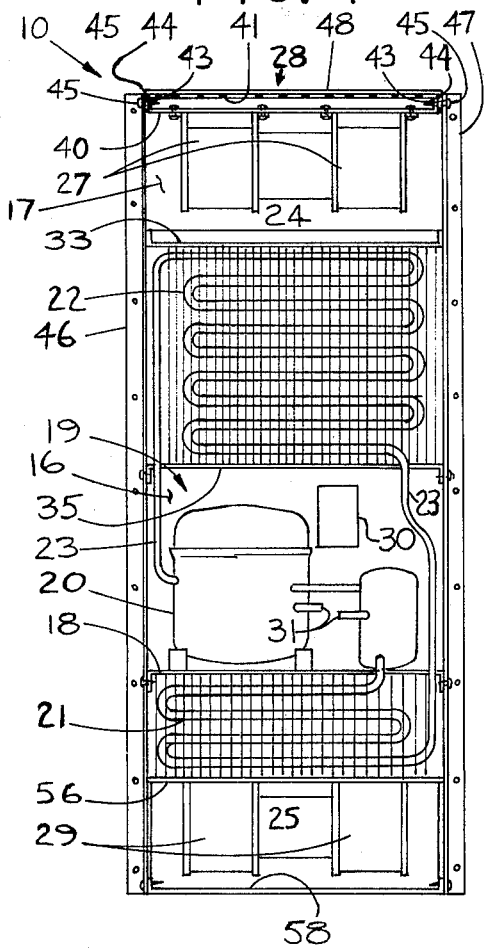

AIR CONDITIONER

BACKGROUND OF THE INVENTION

1. Field of the Invention

This invention pertains to an enclosure box air conditioner having a cabinet and refrigeration chassis, and an evaporator inlet plenum, a condenser air exhaust plenum, and a filter holder.

2. Prior Art

Industrial usage air conditioners specifically intended for enclosure boxes are typically of an integral cabinet and chassis construction and the operable refrigeration system cannot be installed or removed without breaking the refrigerant circuitry. The prior art enclosure air conditioner also require precisely located inlet and outlet apertures in an enclosure wall. Because of this requirement, the air conditioners are not interchangeable between manufacturers nor are different sized conditioner cabinets interchangeable with each other. Further the requirement for precise location of inlet and outlet does not allow alternate positioning of inlet and outlet apertures for custom development of an air flow pattern optimally suited optimally suited for a particular heat load and consequently a larger conditioner than needed may have to be installed in order to cool a critical heat load. The prior industrial air conditioners usually blow hot condenser air out a side outlet in order to preclude the condenser outlet being covered with workman's tools and materials, and the side exhaust of hot air increases the temperature of a workman's environment as well as blowing dust and foreign materials about. Typical usage for an enclosure air conditioner is on the electronic control boxes of automated process lines or large complicated machine tools and in these environments the air conditioner needs an air filter covering the air inlet to the condenser coil and in many instances the air filter must have a special duty filtering element for things such as carbon dust, paint particles, foundry dirt, textile particles, abrasives, sawdust or any other unusual dust. The prior air conditioners use a special and costly proprietary sized filter or else they use a relatively small size standard filter that is only usable one time.

OBJECTS OF THE INVENTION

Accordingly, it is an object of the present invention to provide an air conditioner for attachment to and use on an enclosure box. It is an important object of the present invention to provide such an air conditioner having a complete and improved refrigeration chassis inside of a relatively easily removable exterior cabinet structure and providing an improved level of reliability in the refrigeration system as well as providing improved accessibility to the components of the refrigeration system for service of the system.

It is another object of the present invention to provide an air conditioner for cooling the interior of a control enclosure box in an industrial environment.

Another object of the present invention is to provide an air conditioner having a plenum for drawing hot air through a variety of outlets from an enclosure box.

Yet another object of the present invention is to provide an air conditioner having a non-obstructable outlet from the top of the air conditioner cabinet, for cooling an enclosure box.

A further object of the present invention is to provide an enclosure box air conditioner having a filter holder and condenser inlet enabling double usage of a single air filter.

SUMMARY OF THE INVENTION

In accordance with this invention, an air conditioner is provided having a cabinet wrap attachable to the wall of the enclosure box, and an operable refrigeration system within the cabinet wrap, distinct features of the present invention including a complete refrigeration chassis on a L-shaped frame mounted in the cabinet, an inlet plenum on the back side of the air conditioner, a screen covered exhaust plenum on the top of the air conditioner and a condenser air filter holder which will functionally hold an air filter in either first or second positions enabling double usage of a single filter.

ON THE DRAWINGS:

FIG. 2 is a top view of the structure of FIG. 1;

FIG. 3 is an elevational front view of the structure of FIG. 1;

FIG. 4 is an elevational sectional view taken along section lines IV—IV of FIG. 1.

AS SHOWN ON THE DRAWINGS

Figure 1:
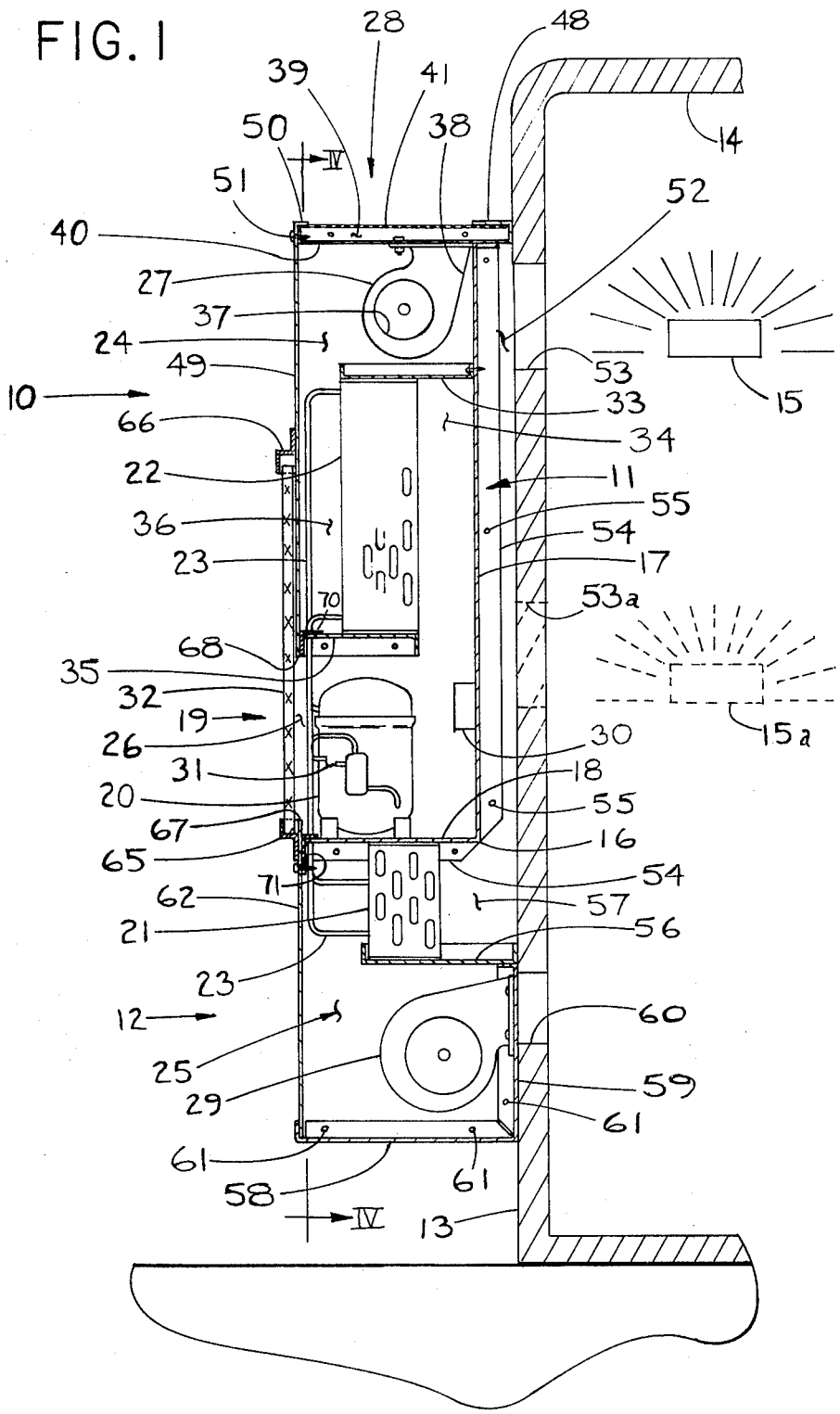
FIG. 1 is an elevational cross sectional view of the preferred embodiment of an air conditioner provided in accordance with the present invention showing the air conditioner mounted on the wall of an enclosure box.

The principles of the present invention are particularly useful when embodied in an air conditioner of the type shown in FIG. 1 and generally indicated by the numeral. 10. The air conditioner 10 has a refrigeration chassis generally indicated by the numeral 11 which is mounted inside of a cabinet generally indicated by the numeral 12 which is mounted to a wall 13 of an enclosure box 14 having an internal heat load 15 which must either be cooled or maintained at a relatively reduced temperature.

The refrigeration chassis 11 has a frame 16 in the shape of an L with a first leg 17 and a second leg 18. The frame 16 serves to support an operative refrigeration system generally indicated by the numeral 19 which has a compressor 20, an evaporator coil 21, a condenser coil 22 and interconnecting refrigerant lines 23, all of which are mounted on the frame 16. The frame 16 divides the interior of the cabinet 12 into a first chamber 24 and a separate second chamber 25. The first chamber 24 has an air inlet 26 for ambient air and an exhaust fan 27 for drawing ambient air over the compressor 20 and through the condenser coil 22 and exhausting the air out the top end 28 of cabinet 12. The second chamber 25 has the evaporator coil 21 and an exhaust fan 29 mounted to blow cold air into the enclosure box 14.

The first chamber 24 has the part of the refrigeration system 19 for transferring of heat removed from the enclosure box 14 to ambient air. The air inlet 26 opens to the compressor 20, an electrical service box 30 and a pair of refrigeration charging connectors 31, all of which are accessible from and through the air inlet 26 when the air filter 32 is removed. The compressor 20 is shown mounted to the horizontal lower leg 18, but it must be explained that the air conditioner 10 can be alternatively modified to be mounted on the top wall of the enclosure box 14 and the compressor could be mounted on the vertical leg 17; in either application the compressor is mounted on one of the legs 17 or 18. The condenser coil 22 has a combination support and air baffle bracket 33 attached to the vertical leg 17, supporting the condenser coil 22 and spacing the condensor coil 22 forward of the leg 17 providing an air passageway 34 into and up along the backside of the condensor coil 22. On the bottom of the condensor coil 22 there is a bracket 35 which secures the bottom of the condensor coil 22 and also is positioned to direct incoming ambient air over and across the compressor 20 to the passageway 34 and then into the backside of the condenser coil 22. Ambient air is drawn through the condenser coil 22 by an exhaust fan 27 which pulls through the condenser coil 22 into an air passageway 36 in front of the condenser coil 22 and then into a fan inlet 37; the fan then blows the hot condenser exhaust air out an exhaust duct 38 which is ducted into an exhaust plenum chamber 39 through a baffle 40 separating the inside of the plenum chamber 39 from the inside of the first chamber 24. The exhaust plenum chamber 39 has a perforated top screen 41 through which the exhaust duct 38 is arranged to blow almost straight up.

An important feature of the present structure of the invention is the condenser air exhaust plenum 39 and in FIG. 2 the plenum 39 is seen from the top. The screen 41 can clearly be seen covering the plenum baffle 40 and an outlet 42 from each of the exhaust fan ducts 38. The screen 41 is shown as being a flat sheet of expanded metal. Referring to FIG. 3, the exhaust plenum chamber 39 is shown in section from the front side of the air conditioner 10. The plenum baffle 40 has a pair of upturned flanges 43 and the screen 41 has a pair of downturned flanges 44, the sheared ends of which face in towards the first chamber 24 and are therefor hidden for precluding personnel injury from the sharp edges. The exhaust plenum baffle 40 forms a top end structural panel of cabinet 12 and is held in place by sheet metal screws 45 driven through opposite side panels 46, 47 and through the screen flanges 44. The screws 45 pass through apertures in the screen flanges 44 and the points of the screws 45 are inside of the exhaust plenum chamber 39. The screen flanges 44 are also compressively held between the baffle flanges 43 and the side panels 46, 47. Referring back to FIG. 1, the exhaust plenum baffle 40 has a C-shaped flange 48 on the back edge with the closed side of the flange 48 sealing against the enclosure box wall 13 and with the open side facing into the plenum 39. The back edge of the screen 41 is under and is covered by the top of C-flange 48 so that the sharp edges of the screen 41 are concealed. There is an end front cover 49 closing the first chamber 24 and this cover 49 has a top flange 50 extending over the concealing the front edge of the screen 41. The cover 49 is fastened to plenum baffle 40 by sheet metal screws 51 which have their points inside of the plenum chamber 39. The condenser exhaust fan 27 is mounted to the exhaust plenum baffle 40 and when the screws 51 and cover 49 are removed from the air conditioner 10, the screws 45 may be removed from side panels 46, 47; and the baffle 40, attached fan 27 and screen 41 are then removable as a unit from the air conditioner 10 for service, cleaning or replacement of the fan 27.

Another important feature of this invention is an inlet plenum 52 in the back of cabinet 12. The frame 16 serves as a divider panel in the cabinet 12 and the vertical leg 17 forms a plenum panel spaced inwardly from and parallel to the back of cabinet 12. The leg 17 extends across the width of the cabinet 12 and from the top end to adjacent to the evaporator fan 29 and divides off within the cabinet 12 an inlet plenum 52 extending the width and most of the length of the cabinet 12 for registering with a hot air outlet 53 in the enclosure box wall 13 as long as the outlet 53 is within the area of the wall 13 which is covered by the inlet plenum 52. Each leg or panel 17, 18 of the frame 16 has side flanges 54 and the side flanges 54 of the plenum panel 17 are turned toward the backside of the cabinet 12 and are removably fastened to the side panels 46, 47 by sheet metal screws 55 which all have their points extending into the plenum chamber 52. The evaporator coil 21 is spaced forward on the leg 18 from the plenum panel or leg 17 and has an evaporator coil baffle 56 mounted on the bottom which also serves as a condensate tray. The evaporator baffle 56 extends from the evaporator coil 21 to the backside of cabinet 12 thus providing a path for air flow from the inlet plenum 52, through the evaporator coil 21 and into the exhaust fan 29. The evaporator baffle 56 also, together with the leg 18, defines an evaporator intake plenum 57 between the evaporator coil 21 and the inlet plenum 52. With the inlet plenum 52 in and open to the backside of the cabinet 12, the enclosure box outlet 53 can be alternatively located for a different heat load, such as the alternative heat load 15*a* and the corresponding alternative outlet 53*a*. The exhaust plenum baffle 40 has the rear flange 48 forming the top end of the inlet plenum 52 and also provides a surface for sealing to the enclosure box wall 13.

The front side of the cabinet 12 is covered and closed off by a front cover formed by a separate and individual first cover 49 covering the first chamber 24 and a second cover 62 covering and closing off the second chamber 25. Each of the covers 49, 62 is removably fastened to a cabinet wrap formed of the side panels 46, 47 and the exhaust plenum baffle 40 and the bottom or second end panel 58 and each cover 49, 62 is removable from the cabinet wrap while the other remains fastened. The bottom end panel 58 has an upright leg 59 to which the exhaust fan 29 is mounted, the exhaust fan 29 being ducted through the leg 59 for registering with a cold air inlet 60 in the enclosure box wall 13. The bottom end panel 58 and its leg 59 are removably fastened to side panels 46, 47 by screws 61 and when the second chamber front cover 62 is removed and screws 61 are removed, the bottom end panel 58 and attached fan 29 are removable as a unit from the air conditioner 10 while the conditioner 10 is installed on the wall 13.

The second end front cover 62 is supported by the bottom end panel 58 and is also fastened to the frame leg 18 for partially supporting the compressor 20. The cover 62 is also fastened to the side panels 46, 47 as shown in FIG. 3. Each side panel 46, 47 is removably fastened to the baffles 40, 35, to the frame flanges 54 and to the bottom end panel 58. On the backside of each side panel 46, 47 there is a flange 63 through which fasteners 64 enter for attaching the air conditioner 10 to the enclosure wall 13. While the ends and fans are removable as units as previously described, each side panel 46, 47 is also removable from the air conditioner 10, while the air conditioner 10 is mounted on the enclosure wall 13, for access to the refrigeration system 19. Removal of either side panel 46, 47 is accomplished by removal of fasteners from baffles 40, 35, flanges 54, panel 58 and the enclosure wall 13 for a respective side panel.

A further important feature of this invention is the provision of first retainer 65 and a second filter retainer 66 which together form a holder for filter 32 and together with the opening 26 enable the filter 32 to be turned end for end in the holder and used twice. The inlet 26 is formed between a top edge 67 of the lower front cover 62 and a bottom edge 68 of the top front cover 49. The first retainer 65 is a z-shaped bracket mounted adjacent to the edge 67 and forming on the lower front cover 62 a pocket having a depth about equal to the usual frame section around the periphery of an air filter 32. The second retainer 66 is mounted to the upper front cover 49 and is spaced from the upper cover bottom edge 68 a distance of twice the size of the air inlet 26 as measured between the retainers 65 and 66. As an example, a common and standard size of air filter is 16 × 25 inches. The air inlet 26 would be about 12 inches high and the retainers 65, 66 would be about 25 inches apart. When the filter 32 is in the retainers 65 and 66, only one half of the filter 32 will cover the air inlet 26. The second retainer 66 has a pocket about twice the depth of the pocket in the first retainer 65 and to install the filter 32, one end of the filter 32 is pushed into the second retainer 66 and the filter 32 is then pushed backwardly in over the top of the lower or first retainer 65 and allowed to drop into the lower or first retainer 65. For removal, the filter 32 is pushed up into upper retainer 66 and pulled out over the lower retainer 65 and then out from the upper retainer 66. Either end of the filter 32 will fit in either of the retainers 65 or 66 and the filter 32 can be turned end for end and used twice before replacement. As previously explained, the compressor 20, electrical service 30 and refrigerant charging connectors 31 are serviceably accessible when the filter 32 is removed. Referring to FIG. 3, there is shown an end flange 69 on each of retainers 65 and 66 for centering the covering end of air filter 32 over the air inlet 26. It should be appreciated that the filter retainers 65 and 66 are sized to hold a standard sized easily available air filter and provide ease in changing readily procurable replacement filter elements.

Figure 5:
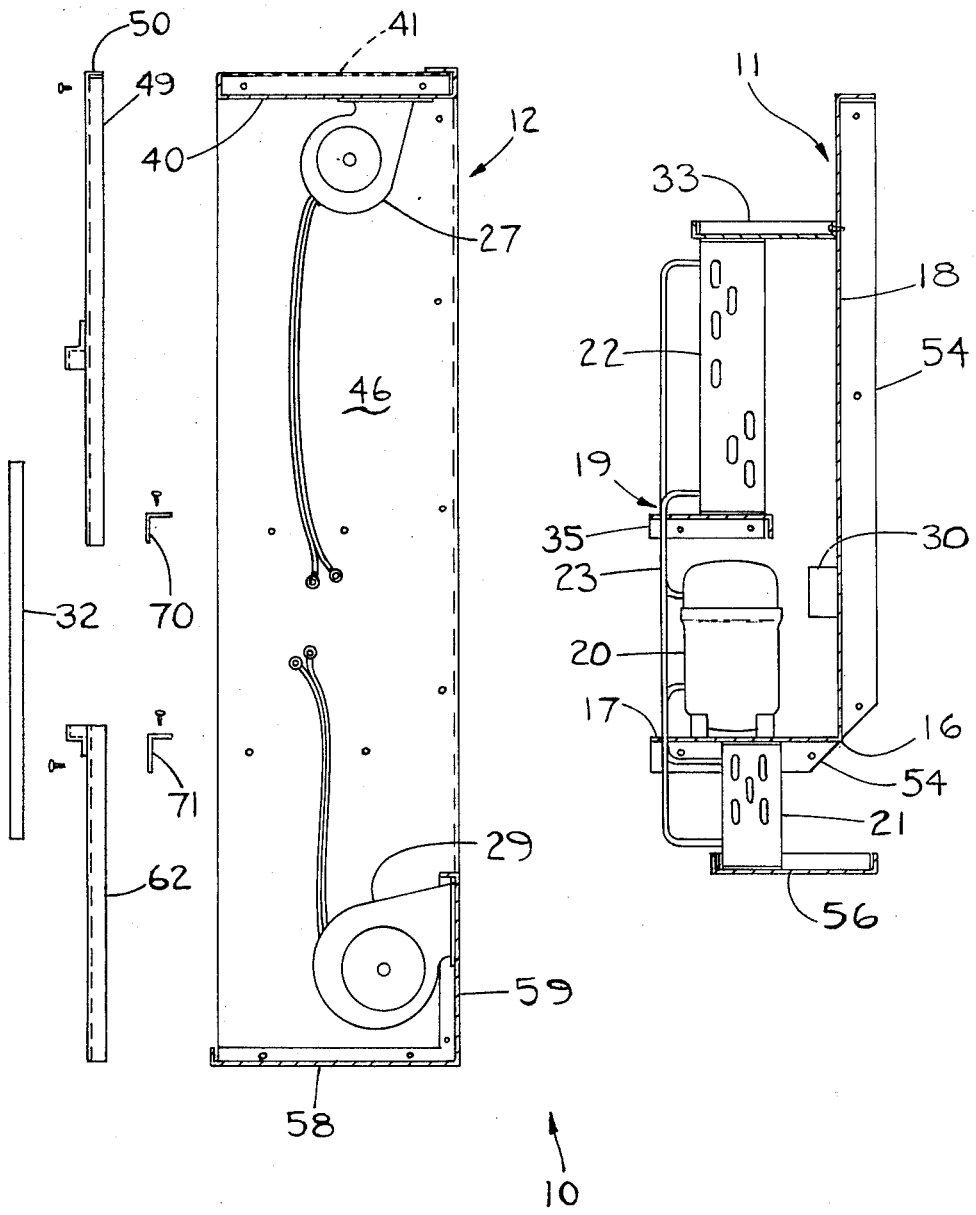
FIG. 5 is an exposed elevational cross sectional view of the components of the structure of FIG. 1.

The basic components of the air conditioner 10 are shown in FIG. 5 as being the complete refrigeration chassis 11, the cabinet 12, and the covers 49 to 62. The refrigeration chassis 11 is built up and completed to the configuration shown in FIG. 5 with the L-shaped frame having the compressor 20, evaporator 21, condenser 22, electrical service box 30 and baffles 33, 35 and 56 all assembled and ready for use. All refrigeration assembly, charging, leak testing and repair is completed on the chassis 11 and when done, the chassis 11 in installable and mountable in the cabinet 12 as an integral unit.

The cabinet 12 has the side panels (46 being shown) removably fastened to the plenum baffle 40 and to the lower end panel 58 with the exhaust fans 27 and 29 installed on their respective panels. The refrigeration chassis 11 will go right in the backside of the assembled cabinet 12 as shown in the configuration of FIG. 5. At assembly, the refrigeration chassis 11 may be either suspended upright or layed down and the cabinet 12 may merely be pushed upon the chassis 11 and the respective fasteners driven through the side panels and into the flanges of the frame 16 and baffles 33, 35 and 58. The electrical leads from fans 27 and 29 are then hooked up to the electrical service box 30 and the L-shaped retainer straps 70 and 71 are mounted on the baffle 35 and the frame leg 18 to retain the refrigeration lines 23 and the fan wires. The upper and lower covers 49, 62 are then mounted and fastened and the air conditioner 10 is complete.

The air conditioner 10 of the present invention is an extremely highly efficient device and also extremely economical and serviceable. The cabinet design is simple and employs efficient use of sheet metal. The machinery required to make the sheet metal of air conditioner 10 is simple and easy to obtain. The reliability of the unit is high because of the excellent access to the refrigeration system 19 during fabrication. A service man can obtain complete access to the refrigeration system 19 or fans 27, 29 without removing the air conditioner 10 from an enclosure box 14. The cabinet 12 does not present any sharp or jagged edges which could produce persons injuries and the condenser exhaust is virtually jam proof even if wrenches or gloves were placed on the screen 41.

The air conditioner 10 is suitable to replace almost all other types of units because the evaporator fan 29 need only be registered with an inlet 60 to an enclosure box 14 and the outlet 53 from the enclosure box 14 can be anywhere within the area of the wall 13 covered by the inlet plenum chamber 52 and the evaporator intake plenum 57.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An air conditioner for attachment to the exterior wall of an enclosure box for controlling the temperature within the enclosure box, comprising:

a. an outer cabinet wrap having
   1. A pair of side panels attached to a pair of end panels and forming a rectangular shaped wrap having an open front and back, there being a peripheral edge around the back having means for mounting of the air conditioner to the wall of an enclosure box,
   2. a first fan mounted to the inside of the wrap adjacent to a first one of the ends, the fan being ducted for exhausting air from within the wrap, and
   3. a second fan mounted to the inside of the wrap adjacent to the second end, the second fan being ducted for blowing air from within the wrap out the back of the wrap and into an inlet in the enclosure wall;

b. a refrigeration chassis having
   1. a frame having first and second legs forming an L-shape,
   2. an operable refrigeration system mounted on the frame with a compressor and a condenser coil mounted on a first side of the L-shaped frame and an evaporator coil mounted on a second side of the L-shaped frame,
   3. the chassis being mounted in the wrap with a first leg of the L-shaped frame being adjacent and parallel to the back and the second leg extending between the wrap front and the back, the frame being attached to each side of the wrap and dviding the wrap into first and second chambers with the compressor, condenser coil and first fan being in the first chamber and the evaporator coil and second fan being in the second chamber;

c. a baffle positioned between the evaporator coil and the wrap back and baffling the second chamber into an air inlet from the wrap back to the evaporator coil and into an air outlet from the evaporator coil to the second fan;

d. an air inlet to the first chamber; and e. a cabinet front cover removably fastened to the wrap and forming in the first chamber a path of air flow from the inlet through the condenser coil and then to the first fan, and also closing the front of the second chamber.

2. An air conditioner according to claim 1, in which the second fan is mounted on and ducted through a back panel extending along the back of the cabinet wrap from the first and panel, the back panel being supportive of the evaporator coil baffle.

3. An air conditioner according to claim 1, in which the L-shaped frame has side flanges thereon, the side flanges being attached to the side panels by removable fasteners.

4. An air conditioner according to claim 3, in which the frame flanges extend into the second chamber and the fasteners are screws extending into the second chamber.

5. An air conditioner according to claim 1, in which the first leg is spaced forward in the cabinet wrap from the back side of the wrap, forming an air inlet plenum in the second chamber and extending most of the length of the cabinet and in fluid communication with the evaporator coil.

6. An air conditioner according to claim 3, in which the condenser coil is mounted to the first leg and the evaporator coil is mounted to the seond leg.

7. An air conditioner according to claim 6, in which the condenser coil is spaced forward of and parallel to the first leg, providing an air passageway between the coil and the leg.

8. An air conditioner according to claim 6, in which the condenser coil has thereon a combination support and air baffling bracket extending from an end of the coil to the front cover, the bracket being removably fastened to the side panels.

9. An air conditioner according to claim 8, in which the bracket is positioned for directing air across the compressor to the condenser coil.

10. An air conditioner according to claim 1, in which the second leg of the frame has the front cover removably fastened thereto.

11. An air conditioner according to claim 1, in which the chassis is initially mountable in the cabinet wrap from the back side of wrap.

12. An air conditioner according to claim 5, in which the first end of the cabinet wrap has an exhaust air plenum into which the first fan is ducted, the exhaust plenum having a baffle with a flange on the back side of the wrap, the flange forming an end of the inlet plenum chamber.

13. An air conditioner according to claim 1, in which the front cover is comprised of individual first and second covers, each end cover being removably fastened to a respective end of the cabinet wrap.

14. An air conditioner according to claim 13, in which the first end cover partially closes the first chamber while providing the air inlet to the condenser coil.

15. An air conditioner according to claim 13, in which either end cover is removable from the cabinet wrap while the other end cover remains on the wrap.

16. An air conditioner according to claim 13, in which each end cover has thereon a retainer, the retainers jointly forming a holder for retaining an air filter over the air inlet.

17. An air conditioner according to claim 16, in which the air inlet is formed between an edge of each end cover, the edges facing and being spaced from each other with one retainer being mounted adjacent to one edge and the other retainer being spaced from a second edge of distance of at least the spacing between the edges.

18. An air conditioner according to claim 1, in which the side panels are removably fastened to the end panels and to the L-shaped frame, either of the side panels being removable from the air conditioner when the air conditioner is mounted on the wall of an enclosure box.

19. An air conditioner according to claim 1, in which the second fan is mounted to the second end panel and the second end panel is removably fastened to the side panels, the second fan and second end panel being removable as a unit from the air conditioner when the conditioner is mounted on the wall of an enclosure box.

20. An air conditioner for attachment to the exterior wall of an enclosure box for controlling the temperature within the enclosure box, comprising:

a. a cabinet having panels forming a box having a back side with means for mounting of the air conditioner to the wall of an enclosure box:

b. an operative refrigeration system within the cabinet;

c. air ducting in the back side of the cabinet for drawing hot air from the enclosure to an evaporator coil and blowing cold air from the coil into the enclosure;

d. an air inlet and an air outlet in and through the cabinet panels for intake of ambient air to a condenser coil and exhaust of heated air from the condenser coil to ambient; and e. an air filter holder mounted on the cabinet and having a pair of filter retainers, a first retainer being adjacent an edge of the air inlet and a second retainer being on the opposite side of the air inlet and spaced from the first retainer a distance of twice the size of the air inlet as measured between the retainers, for retaining an air filter to the cabinet with one half of the filter covering over the air inlet, the retainers being able to identically retain the air filter when the filter is turned end for end so that the filter may be used twice before replacement thereof.

21. An air conditioner according to claim 20, in which the first retainer is a Z-shaped bracket forming a pocket into which a first edge of an air filter may be placed, and the second retainer is a Z-shaped bracket forming a pocket into which a second and opposite edge of an air filter may be placed, the second retainer having a pocket twice as deep as a pocket of the first retainer.

22. An air conditioner according to claim 21, in which the first retainer is below the second retainer.

23. An air conditioner for attachment to the exterior wall of an enclosure box for controlling the temperature within the enclosure box, comprising:

a. a cabinet having panels forming a box having a back side with means for mounting of the air conditioner to the wall of an enclosure box;
b. an operative refrigeration system within the cabinet;
c. an air inlet and an air outlet in and through the cabinet panels for intake of ambient air to a condenser coil and exhaust of heated air from the condenser coil to ambient;
d. a fan mounted adjacent a first end of the cabinet, said fan having an exhaust duct with an outlet on the back of the cabinet, said exhaust duct outlet being registrable with an air inlet in the enclosure box wall;
e. a plenum panel mounted inside of the cabinet, the plenum panel being spaced inwardly from and generally parallel to the back of the cabinet and extending across the width of the cabinet and from a second end of the cabinet to a position adjacent to the fan, the plenum panel forming with cabinet side panels an inlet plenum extending the width of the cabinet and most of the length of the cabinet;
f. a divider leg extending from the plenum panel and toward a front of the cabinet;
g. an evaporator coil mounted against the divider leg, said evaporator coil being positioned inside of the cabinet and in a position between the divider leg and said first end of the cabinet; and
h. a baffle extending from the evaporator coil to the back of the cabinet, said baffle being positioned between the evaporator coil and said first cabinet end, and forming with said divider leg an evaporator intake plenum positioned between said plenum panel and said first end, said evaporator intake plenum being open to the back of the cabinet and being in fluid communcation with the inlet plenum, said intake and inlet plenums providing a path for air flow into and through the evaporator coil from an enclosure fair outlet anywhere within the area of an enclosure wall covered by the inlet plenum and intake plenum.

24. An air conditioner for attachment to the exterior wall of an enclosure box for controlling the temperature within the enclosure box, comprising:
a. a cabinet having panels forming a box having a back side with means for mounting of the air conditioner to the wall of an enclosure box;
b. an operative refrigeration system within the cabinet;
c. air ducting in the back side of the cabinet for drawing hot air from the enclosure to an evaporator coil and blowing cold air from the coil into the enclosure;
d. an air inlet in and through one of the intake of ambient air to a refrigeration condenser coil;
e. a fan having an intake for drawing air from the condenser coil and an exhaust duct for directing exhaust air in an upwardly direction out of the cabinet;
f. an exhaust air plenum in the top of the cabinet, the plenum having a lower baffle forming a structural top end panel of the cabinet and separating the inside of the exhaust plenum from the inside of the cabinet, the fan exhaust duct being routed through the baffle for exhausting into the exhaust plenum;
g. a perforated initially flat sheet metal screen mounted atop the plenum and forming a vertically upward directed air outlet from the plenum well as at least part of the cabinet exterior top surface;
h. an upturned flange on each side of the baffle, each flange facing against a respective cabinet side panel;
i. a downwardly bent flange on each side of the sheet metal screen, each screen flange being in between a respective baffle side flange and a cabinet side panel; and
j. fasteners driven through each respective side panel, screen flange and baffle side flange and into the exhaust air plenum, said screen flanges being compressively held in between the side panels and the baffle side flanges, for retention of the screen to the cabinet.

25. An air conditioner for controlling the temperature within an enclosure, comprising:
a. an exterior cabinet wrap for enclosing a refrigeration chassis, said cabinet wrap having a back side for being mounted against and enclosure box;
b. a refrigeration chassis mounted within the cabinet wrap, said refrigeration chassis having
1. a structural frame having first and second adjoining legs forming an L-shaped,
2. an operable refrigeration system mounted on the frame with a compressor and a condenser being mounted on a first side of the L-shaped frame, and an evaporator being mounted on a second side of the L-shaped frame, and
3. said chassis being mounted in the wrap with the first leg of the L-shaped frame being adjacent and generally parallel to the back side of the cabinet wrap, and the second leg being positioned between a front side of the cabinet wrap and said back side, said L-shaped frame dividing the interior of the cabinet wrap into first and second interior air chambers with the compressor and condenser being in the first chamber and with the evaporator being in the second chamber;
c. An air inlet and an air outlet through the cabinet wrap, said inlet and outlet together with the L-shaped frame and cabinet wrap providing a fluid pathway through the first chamber for the intake of ambient air to be passed through the condenser and for the exhaust of such air after passage through the condenser;
d. a fan in fluid communication with the first chamber for moving a flow of air through the first chamber and through the condenser;
e. a hot air inlet and a cooled air outlet in the back side of the cabinet, said hot air inlet and cooled air outlet together with said L-shaped frame and cabinet wrap providing a fluid pathway through the second chamber for the intake of hot air from an enclosure box and passing of this hot air through the evaporator and thence the exhaust of this hot air back into the enclosure box after the hot air is cooled by the evaporator;
f. a fan in fluid communication with the second chamber for moving a flow of enclosure box air through the second chamber and the evaporator; and
g. means for mounting the air conditioner on the wall of an enclosure box.

* * * * *